US012258832B2

(12) United States Patent
Al-Mousa et al.

(10) Patent No.: US 12,258,832 B2
(45) Date of Patent: Mar. 25, 2025

(54) METHODS FOR WELLHEAD WORKOVER

(71) Applicant: Saudi Arabian Oil Company, Dhahran (SA)

(72) Inventors: Ahmed Abdullah Al-Mousa, Doha (SA); Omar Saud Almuhaidib, Khobar (SA); Omar M. Alhamid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/351,922

(22) Filed: Jul. 13, 2023

(65) Prior Publication Data

US 2025/0020038 A1 Jan. 16, 2025

(51) Int. Cl.
*E21B 33/04* (2006.01)
*E21B 34/02* (2006.01)

(52) U.S. Cl.
CPC ..... *E21B 33/04* (2013.01); *E21B 34/025* (2020.05)

(58) Field of Classification Search
CPC ..... E21B 33/04; E21B 33/0353; E21B 33/03
See application file for complete search history.

(56) References Cited

U.S. PATENT DOCUMENTS

| | | | | |
|---|---|---|---|---|
| 4,832,124 | A * | 5/1989 | Rayson | E21B 41/08 166/360 |
| 5,182,946 | A * | 2/1993 | Boughner | E21B 47/007 702/6 |
| 8,695,713 | B2 | 4/2014 | June et al. | |
| 11,168,532 | B2 * | 11/2021 | Mukhlifi | E21B 33/068 |
| 11,913,300 | B1 * | 2/2024 | Karakaya | E21B 34/02 |
| 2011/0240307 | A1 | 10/2011 | Nguyen et al. | |

FOREIGN PATENT DOCUMENTS

BR PI0918921 A2 12/2015

* cited by examiner

*Primary Examiner* — Catherine Loikith
(74) *Attorney, Agent, or Firm* — Dinsmore & Shohl LLP

(57) ABSTRACT

The method includes providing a wellhead comprising a first casing spool and an extended tubing spool disposed above the first casing spool, and a production tree comprising a wing valve disposed above the extended tubing spool. The method further includes decoupling the extended tubing spool from the wellhead, coupling a replacement tubing spool and an additional casing spool below the replacement tubing spool to the wellhead replacing the extended tubing spool. A combined length of the replacement tubing spool and the additional casing spool is the same as the length of the extended tubing spool. The method further includes maintaining a consistent vertical length between the first casing spool and the wing valve while replacing the extended tubing spool with the replacement tubing spool and the additional casing spool.

9 Claims, 2 Drawing Sheets

METHODS FOR WELLHEAD WORKOVER

TECHNICAL FIELD

Embodiments described herein generally relate to methods for wellhead workover.

BACKGROUND

In oil and gas drilling, a wellhead usually includes casing spools and tubing spools, and a production tree (e.g., a christmas tree) is coupled to on the top of the wellhead. In case of wellhead workover, adding a new casing spool may increase the height of the wellhead. The production tree is usually coupled to a production line, and changing the height may require reconstruction on the production tree. For example, a well may not be connected to a production line directly as a result of workover. Therefore, wellhead workover is a potentially time consuming and costly repair operation. A wait time of workover may be about 30 days or more on average.

SUMMARY

In accordance with one embodiment of the present disclosure, a method is provided. The method includes providing a wellhead comprising a first casing spool and an extended tubing spool disposed above the first casing spool, and a production tree comprising a wing valve disposed above the extended tubing spool. The method further includes decoupling the extended tubing spool from the wellhead, coupling a replacement tubing spool and an additional casing spool below the replacement tubing spool to the wellhead replacing the extended tubing spool. A combined length of the replacement tubing spool and the additional casing spool is the same as the length of the extended tubing spool. The method further includes maintaining a consistent vertical length between the first casing spool and the wing valve while replacing the extended tubing spool with the replacement tubing spool and the additional casing spool.

Additional features and advantages of the described embodiments will be set forth in the detailed description, which follows, and in part will be readily apparent to those skilled in the art from that description or recognized by practicing the described embodiments, including the detailed description, which follows, as well as the claims.

BRIEF DESCRIPTION OF THE SEVERAL VIEWS OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to a method for wellhead workover.

Figure 1:
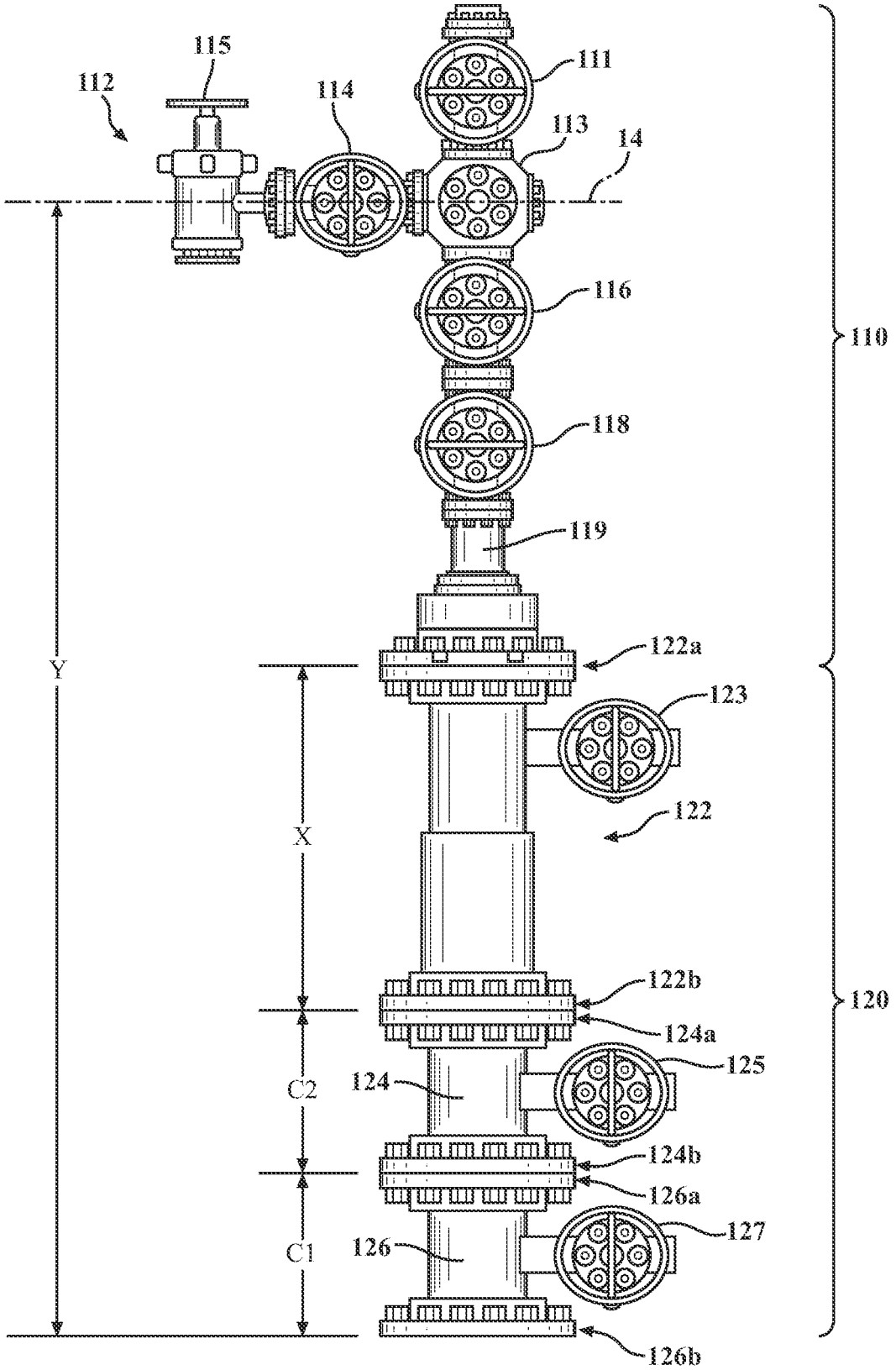
FIG. 1 is an illustrative drawing of a production tree and a wellhead according to one or more embodiments herein.

Referring initially to FIG. 1, a production tree 110 and a wellhead 120 are illustrated. The production tree 110 is fitted to the wellhead 120 of a completed well to control production. The production tree 110 may include a swab valve 111, a tree 113, a wing valve 114 (e.g., a production wing valve), a choke 115 (e.g., a production choke), an upper master valve 116, a lower master valve 118, and a tubing head adapter 119. The swab valve 111 is the topmost valve on a production tree 110 that provides vertical access to a wellbore. The tree 113 couples a production wing 112 horizontally to the production tree 110. The production wing 112 may include the wing valve 114 and the choke 115. The wing valve 114 is located on the side of the production tree 110. The wing valve 114 may be used to control and isolate production. The wing valve 114 may be coupled to a production line (not shown) that further couples the production tree to a production facility. The choke 115 is a device incorporating an orifice that is used to control fluid flow rate or downstream system pressure.

Further below the production wing 112 are an upper master valve 116, a lower master valve 118, and a tubing head adapter 119. A master valve controls all flow from the wellbore, and thus a correctly functioning master valve is important. Therefore, two master valves (e.g., the upper master valve 116 and the lower master valve 118) may be used in embodiments. The upper master valve 116 may be used on a routine basis, and the lower master valve 118 may provide backup or contingency function in the event that the upper master valve 116 is leaking and needs replacement. The tubing head adapter 119 may provide a means of attaching the production tree to the wellhead 120. Instead of the two master valve (e.g., the upper master valve 116 and the lower master valve 118) configuration as described above, one master valve may be utilized in embodiments.

Still referring to FIG. 1, the wellhead 120 may include an extended tubing spool 122 and a corresponding valve 123, a first casing spool 126 and a corresponding first casing valve 127. A casing spool (e.g., the first casing spool 126) generally secures an upper end of a casing string. During a construction process of a wellbore, casings are lowered in an open hole and cemented in place. For example, casings are run to protect freshwater formations adjacent to the wellbore, isolate a zone of lost returns, or isolate formations with significantly different pressure gradients. A tubing spool (e.g., the extended tubing spool 122) generally supports a tubing pipe placed in the casings. For example, the tubing pipe may be a production tubing used to produce reservoir fluids.

In embodiments, the wellhead 120 may further include a second casing spool 124 and a corresponding second casing valve 125. As shown in FIG. 1, the second casing spool 124 may be disposed below the extended tubing spool 122. The second casing spool 124 may be disposed between the extended tubing spool 122 and the first casing spool 126.

In embodiments, the extended tubing spool 122 has a vertical length X that is longer than a vertical length of the first casing spool 126. A vertical length used herein is defined as a length in a vertical direction between a longitudinal end and an opposite longitudinal end. For example, the vertical length X is a length in the vertical direction between a longitudinal end 122*a* and a longitudinal end 122*b* of the extended tubing spool 122. The first casing spool 126 has a vertical length C1 that is a length in the vertical direction between a longitudinal end 126*a* and a longitudinal end 126*b*. The second casing spool 124 has a vertical length C2 that is a length in the vertical direction between a longitudinal end 124*a* and a longitudinal end 124*b*. In embodiments, the vertical length X of the extended tubing spool 122 may be the same as a combined length of the vertical length C1 of the first casing spool 126 and the vertical length C2 of the second casing spool 124. In embodiments, the vertical length C1 of the first casing spool 126 may be the same as the vertical length C2 of the second casing.

A vertical length Y shown in FIG. 1 is a vertical length between the first casing spool 126 and the wing valve 114. The length Y is defined by a length between the longitudinal end 126*b* and a location of a reference line 14 of the wing valve 114 perpendicular to the longitudinal direction of the wellhead 120. For example, the reference line 14 may be a centerline of the wing valve 114 as shown in FIG. 1. Alternatively, the reference line 14 may be drawn along a bottom end of the wing valve 114, or a top end of the wing valve 114. The reference line 14 may be drawn along any parts of the wing valve 114 as long as the reference line 14 represents the vertical length Y between the first casing spool 126 and the wing valve 114.

Figure 2:
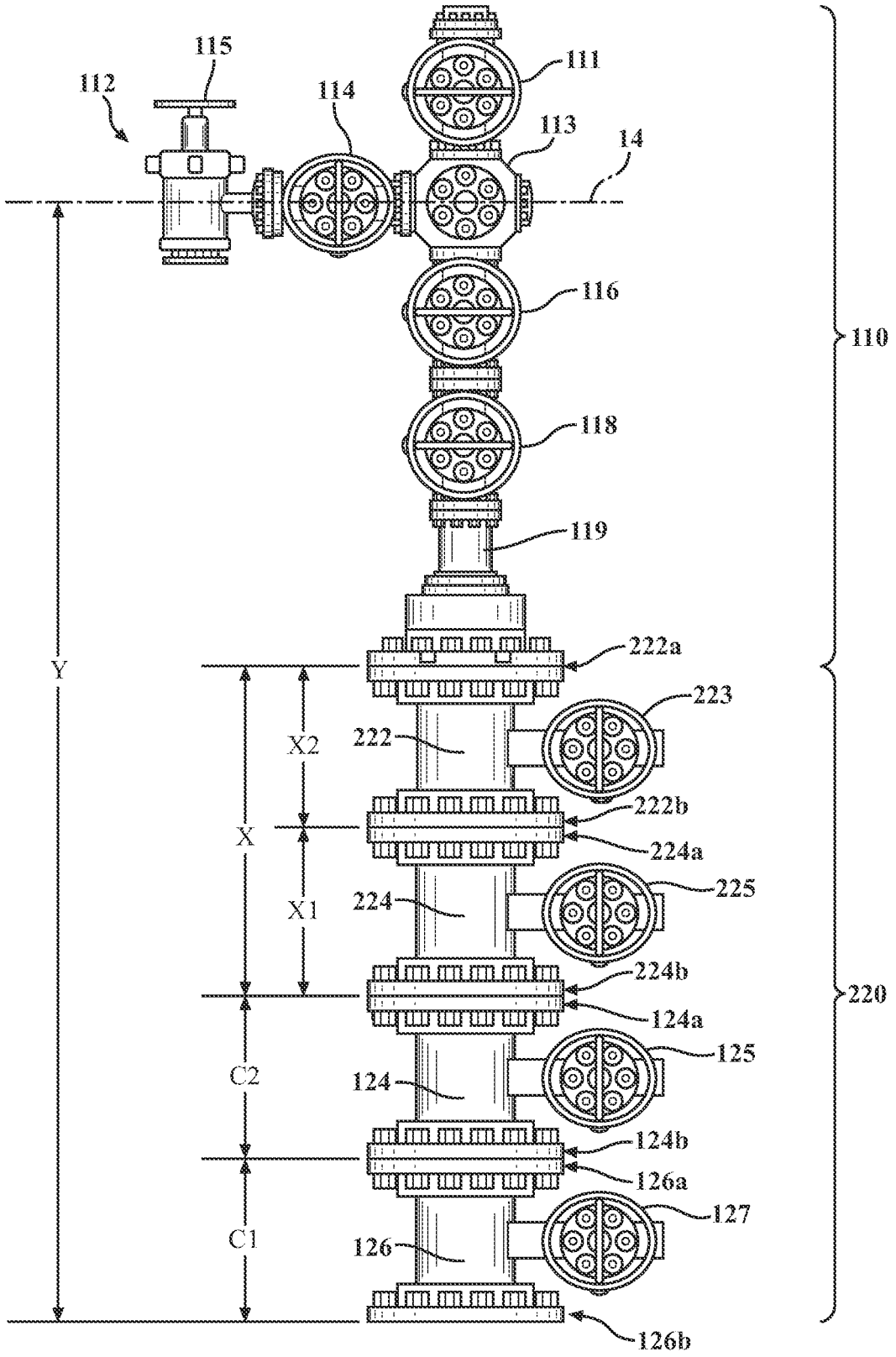
FIG. 2 is an illustrative drawing of a production tree and a wellhead after wellhead workover according to one or more embodiments herein.

Referring to FIG. 2, the production tree 110 and a wellhead 220 are illustrated. The production tree 110 is fitted to the wellhead 220 of a completed well to control production. The production tree 110 is the same as the production tree 110 as described above with reference to FIG. 1, and thus the detailed descriptions of the production tree 110 are omitted. The wellhead 220 shows the configuration of the wellhead 120 (FIG. 1) after workover is done.

In embodiments, the workover includes decoupling the extended tubing spool 122 from the wellhead 120, coupling a replacement tubing spool 222 and an additional casing spool 224 below the replacement tubing spool 222, maintaining a consistent vertical length between the first casing spool 126 and the wing valve 114 while replacing the extended tubing spool 122 with the replacement tubing spool 222 and the additional casing spool 224. In embodiments, the replacement tubing spool 222 has a corresponding valve 223, and the additional casing spool 224 has a corresponding additional casing valve 225. A combined length of the replacement tubing spool 222 and the additional casing spool 224 are the same as the length of the extended tubing spool 122 (FIG. 1). For example, the combined length of a vertical length X2 of the replacement tubing spool 222 and a vertical length X1 of the additional casing spool 224 is the same as the vertical length X of the extended tubing spool 122 (FIG. 1). The vertical length X1 may be a length in the vertical direction between a longitudinal end 224*a* and a longitudinal end 224*b* of the additional casing spool 224. The vertical length X2 may be a length in the vertical direction between a longitudinal end 222*a* and a longitudinal end 222*b* of the replacement tubing spool 222.

In embodiments, the workover may include maintaining a consistent radial direction of the wing valve 114 while replacing the extended tubing spool 122 with the replacement tubing spool 222 and the additional casing spool 224. For example, the wing valve 114 before the workover as shown in FIG. 1 points toward the same radial direction as the wing valve 114 after the workover as shown in FIG. 2. In other words, the radial direction of the wing valve 114 does not change after the workover.

In embodiments, the workover may include maintaining connection between the wing valve 114 and a production line while replacing the extended tubing spool with the replacement tubing spool and the additional casing spool. For example, the production line connects the wing valve 114 to a production facility.

In embodiments, a length of the additional casing spool 224 may be the same as a length of the first casing spool 126. For example, the vertical length X1 is the same as the vertical length C1. In embodiments, a length of the replacement tubing spool 222 is the same as a length of the first casing spool 126. For example, the vertical length X2 is the same as the vertical length C1. In embodiments, the first casing spool 126, the replacement tubing spool 222, and the additional casing spool 224 may each have the same length. For example, the vertical length C1, the vertical length X1, and the vertical length X2 are the same. In embodiments, the length of the additional casing spool 224 may be the same as a length of the second casing spool 124. For example, the vertical length X1 is the same as the vertical length C2. In embodiments, the length of the replacement tubing spool 222 is the same as the length of the second casing spool 124. For example, the vertical length X2 is the same as the vertical length C2. In embodiments, the second casing spool 124, the replacement tubing spool 222, and the additional casing spool 224 may each have the same length. For example, the vertical length C2, the vertical length X1, and the vertical length X2 are the same. In embodiments, the length of the first casing spool 126, the length of the second casing spool 124, the length of the additional casing spool 224, and the replacement tubing spool 222 are the same. For example, the vertical length C1, the vertical length C2, the vertical length X1, and the vertical length X2 are the same.

In embodiments, the wellhead 220 may further include the second casing spool 124 and the corresponding second casing valve 125. As shown in FIG. 2, the second casing spool 124 may be disposed below the additional casing spool 224. The second casing spool 124 may be disposed between the additional casing spool 224 and the first casing spool 126. The first casing spool 126 and the second casing spool 124 of the wellhead 220 are the same as the first casing spool 126 and the second casing spool 124 of the wellhead 120 as described above with reference to FIG. 1, and thus the detailed descriptions of the first casing spool 126 and the second casing spool 124 are omitted.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

It is noted that the term "the same" utilized herein to include "substantially the same" or "approximately the same." For the purposes of describing and defining the present invention it is noted that the term "substantially" or "approximately" is utilized herein to represent the inherent degree of uncertainty that may be attributed to any quantitative comparison, value, measurement, or other representation. The term "substantially" or "approximately" is also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

One or more aspects of the present disclosure are described here.

A first aspect of the present disclosure may be a method including providing a wellhead comprising a first casing spool and an extended tubing spool disposed above the first casing spool, and a production tree comprising a wing valve disposed above the extended tubing spool. The method further includes decoupling the extended tubing spool from the wellhead, coupling a replacement tubing spool and an additional casing spool below the replacement tubing spool to the wellhead replacing the extended tubing spool. A combined length of the replacement tubing spool and the additional casing spool is the same as the length of the extended tubing spool. The method further includes maintaining a consistent vertical length between the first casing spool and the wing valve while replacing the extended tubing spool with the replacement tubing spool and the additional casing spool.

A second aspect of the present disclosure may include the first aspect, wherein the method further includes maintaining a consistent radial direction of the wing valve while replacing the extended tubing spool with the replacement tubing spool and the additional casing spool.

A third aspect of the present disclosure may include the first aspect or the second aspect, wherein the method further includes maintaining connection between the wing valve and a production line while replacing the extended tubing spool with the replacement tubing spool and the additional casing spool.

A fourth aspect of the present disclosure may include the any of the first through third aspects, wherein a length of the additional casing spool is the same as a length of the first casing spool.

A fifth aspect of the present disclosure may include the any of the first through fourth aspects, wherein a length of the replacement tubing spool is the same as a length of the first casing spool.

A sixth aspect of the present disclosure may include the any of the first through fifth aspects, wherein the first casing spool, the replacement tubing spool, and the additional casing spool have the same length.

A seventh aspect of the present disclosure may include the any of the first through sixth aspects, wherein the wellhead further comprises: a second casing spool disposed below the extended tubing spool, wherein the length of the extended tubing spool is the same as a combined length of the first casing spool and the second casing spool.

An eighth aspect of the present disclosure may include the any of the first through seventh aspects, wherein the second casing spool, the replacement tubing spool, and the additional casing spool have the same length.

A ninth aspect of the present disclosure may include the any of the first through eighth aspects, wherein the second casing spool and the first casing spool have the same length.

What is claimed is:

1. A method comprising:

providing a wellhead comprising a first casing spool and an extended tubing spool disposed above the first casing spool, and a production tree comprising a wing valve disposed above the extended tubing spool;

decoupling the extended tubing spool from the wellhead;

coupling a replacement tubing spool and an additional casing spool below the replacement tubing spool to the wellhead replacing the extended tubing spool, a combined length of the replacement tubing spool and the additional casing spool being the same as a length of the extended tubing spool; and maintaining a consistent vertical length between the first casing spool and the wing valve while replacing the extended tubing spool with the replacement tubing spool and the additional casing spool.

2. The method of claim 1, further comprising:

maintaining a consistent radial direction of the wing valve while replacing the extended tubing spool with the replacement tubing spool and the additional casing spool.

3. The method of claim 1, further comprising:

maintaining connection between the wing valve and a production line while replacing the extended tubing spool with the replacement tubing spool and the additional casing spool.

4. The method of claim 1, wherein a length of the additional casing spool is the same as a length of the first casing spool.

5. The method of claim 1, wherein a length of the replacement tubing spool is the same as a length of the first casing spool.

6. The method of claim 1, wherein the first casing spool, the replacement tubing spool, and the additional casing spool have the same length.

7. The method of claim 1, wherein the wellhead further comprises:

a second casing spool disposed below the extended tubing spool, wherein the length of the extended tubing spool is the same as a combined length of the first casing spool and the second casing spool.

8. The method of claim 7, wherein the second casing spool, the replacement tubing spool, and the additional casing spool have the same length.

9. The method of claim 7, wherein the second casing spool and the first casing spool have the same length.

* * * * *